US011644003B2

(12) United States Patent
Irie

(10) Patent No.: US 11,644,003 B2
(45) Date of Patent: May 9, 2023

(54) IGNITION DEVICE FOR INTERNAL COMBUSTION ENGINE

(71) Applicant: DENSO CORPORATION, Kariya (JP)

(72) Inventor: Masashi Irie, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/509,296

(22) Filed: Oct. 25, 2021

(65) Prior Publication Data

US 2022/0128024 A1 Apr. 28, 2022

(30) Foreign Application Priority Data

Oct. 27, 2020 (JP) ..... JP2020-179482

(51) Int. Cl.

| | |
|---|---|
| ***F02P 3/055*** | (2006.01) |
| ***F02P 11/02*** | (2006.01) |
| ***F02P 3/05*** | (2006.01) |
| ***F02P 17/12*** | (2006.01) |

(52) U.S. Cl.

CPC ..... *F02P 3/0552* (2013.01); *F02P 3/051* (2013.01); *F02P 11/02* (2013.01); *F02P 17/12* (2013.01)

(58) Field of Classification Search

CPC ..... F02P 3/0552; F02P 3/051; F02P 11/02; F02P 17/12; G01F 1/10

See application file for complete search history.

(56) References Cited

U.S. PATENT DOCUMENTS

| | | | | |
|---|---|---|---|---|
| 4,020,816 | A * | 5/1977 | Chateau | F02P 3/0552 361/263 |
| 2004/0011343 | A1* | 1/2004 | Nobe | F02P 11/00 123/644 |
| 2011/0141640 | A1* | 6/2011 | Godo | F02P 3/0442 361/86 |
| 2017/0207618 | A1* | 7/2017 | Miyazawa | F02P 3/0552 |
| 2019/0088736 | A1* | 3/2019 | Yamaguchi | H01L 21/823481 |
| 2021/0104600 | A1 | 4/2021 | Yamaguchi | |

FOREIGN PATENT DOCUMENTS

| | | |
|---|---|---|
| JP | 2005-33611 | 2/2005 |

* cited by examiner

*Primary Examiner* — Logan M Kraft
*Assistant Examiner* — Joshua Campbell
(74) *Attorney, Agent, or Firm* — Nixon & Vanderhye P.C.

(57) ABSTRACT

An ignition device for an internal combustion engine includes a switching circuit and a control circuit. The control circuit monitors a voltage level inputted to a switching device which is installed in the switching circuit and connected to a primary winding of an ignition coil. The control circuit includes an overvoltage protection circuit which outputs an energization inhibit signal to inhibit energization of the switching device when the monitored voltage level is higher than an overvoltage threshold level. When the monitored voltage level exceeds the overvoltage threshold level in an output duration in which the energization control signal is outputted, the overvoltage protection circuit stops output of the energization inhibit signal until the output duration expires. This enables the switching device to be protected from damage and an ignition operation to be executed at a correct timing to eliminate a risk of damage to the internal combustion engine.

8 Claims, 8 Drawing Sheets

COIL-APPLIED POWER : $(VB-Vce)^2/R1$

DEVICE-APPLIED POWER : Vce*I

COIL-APPLIED POWER : $R1*I1^2$

DEVICE-APPLIED POWER : (VB-R1*I1)*I1

IGNITION DEVICE FOR INTERNAL COMBUSTION ENGINE

CROSS REFERENCE TO RELATED DOCUMENT

The present application claims the benefit of priority of Japanese Patent Application No. 2020-179482 filed on Oct. 27, 2020, the disclosure of which is incorporated in its entirety herein by reference.

BACKGROUND

1 Technical Field

This disclosure relates generally to an ignition device for use in internal combustion engines which is equipped with an ignition coil and an igniter.

2 Background Art

Ignition devices for internal combustion engines usually include an ignition coil which outputs a high voltage to ignite an air-fuel mixture in the engine and an igniter which works as an ignition control device to control energization of the ignition coil. The igniter is usually equipped with a switching device, such as an IGBT, and a control circuit which controls an operation of the switching device. The switching device is connected to a primary winding of the ignition coil. The ignition coil has a secondary winding connected to a spark plug. The control circuit turns on or off the switching device to execute an ignition operation to ignite the air-fuel mixture using the spark plug.

Specifically, the igniter turns on or off the switching device in response to an ignition signal inputted to the ignition device. More specifically, the switching device is turned on in response to a rising of the level of the ignition signal to start energizing the primary winding. Afterwards, the switching device is turned off in response to falling of the level of the ignition signal to deenergize the primary winding, thereby developing a high voltage at the secondary winding. The high voltage is then applied to a spark plug to produce an electrical spark.

The control circuit is typically equipped with a protection circuit to protect the igniter from overcurrent or overvoltage. For instance, Japanese Patent First Publication No. 2005-033611 discloses an igniter equipped with an overvoltage protection circuit, a switching device, and a driver circuit. The driver circuit controls energization of an ignition coil using the switching device. The overvoltage protection circuit is connected to a power supply terminal to monitor voltage developed at a storage battery and works to turn off the switching device through the driver circuit when the level of the monitored voltage exceeds a voltage threshold level. This avoids flow of a high current through the switching device due to the occurrence of overvoltage, thereby protecting the switching device from thermal damage.

The overvoltage protection circuit is activated in response to rise of the voltage at the battery which is resulted from occurrence of surge voltage caused by load dump. The turning off of the switching device at a time different from a time of an ignition operation of the igniter may, however, adversely affect the operation of the spark plug. For example, when the overvoltage protection circuit is activated in an on-duration of the switching device turned on in response to input of an ignition signal, it will cause the supply of electrical power to the primary winding to be cut earlier than the correct ignition timing, which develops a high voltage at the secondary winding which is then applied to the spark plug. This leads to unexpected premature ignition, which may result in detonation in the internal combustion engine to damage parts of the internal combustion engine.

SUMMARY

It is, therefore, an object of this disclosure to provide an ignition device capable of avoiding an overvoltage protecting operation at an unexpected time to protect a switching device from damage and also eliminate adverse effects on ignition in an internal combustion engine.

According to one aspect of this disclosure, there is provided an ignition device which comprises: (a) an ignition coil which includes a primary winding and a secondary winding and in which an electrical current flowing through the primary winding is changed to develop a high voltage at the secondary winding; and (b) an igniter which works to energize or deenergize the ignition coil and includes a switching circuit and a control circuit. The switching circuit is equipped with a switching device connected to the primary winding. The control circuit works to control energization of the switching device based on an energization control signal. The control circuit includes an overvoltage protection circuit which monitors a voltage level inputted to the primary winding and is configured to output an energization inhibit signal to inhibit supply of electrical current to the switching device in a range where the monitored voltage level is higher than an overvoltage threshold level. When the monitored voltage level exceeds the overvoltage threshold level in an output duration in which the energization control signal is outputted, the overvoltage protection circuit stops output of the energization inhibit signal until the output duration expires.

The ignition device is, as apparent from the above discussion, capable of protecting the switching device from damage using the overvoltage protection circuit and performing an ignition operation at a correct timing to eliminate a risk of damage to the internal combustion engine.

Symbols in brackets attached to component parts, as discussed below, are used only to indicate exemplified correspondences between the symbols and the component parts. It should be, therefore, appreciated that the invention is not limited to the described component parts.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

Embodiments will be described below with reference to the drawings. Each of the embodiments may be designed to include all possible combinations or modifications of the components in the other embodiments.

First Embodiment

The ignition device 1 for use in an internal combustion engine according to the first embodiment will be described below with reference to FIGS. 1 to 6.

Figure 1:
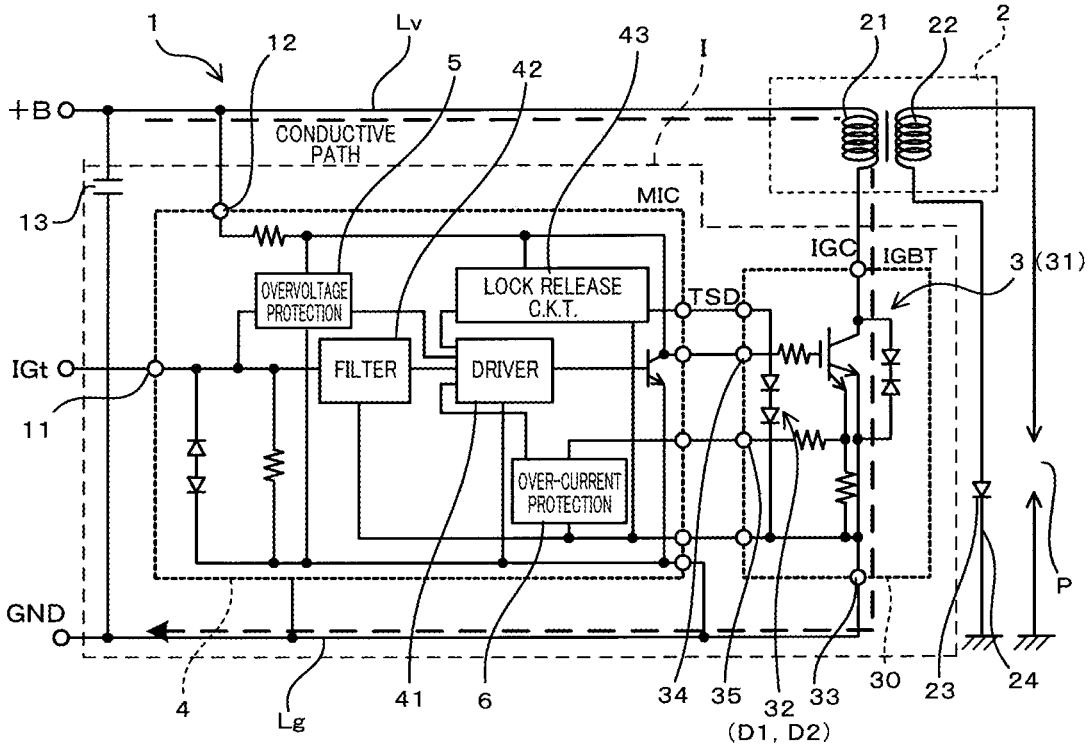
FIG. 1 is a circuit diagram which illustrates a structure of an ignition device for an internal combustion engine according to the first embodiment.

The ignition device 1, as illustrated in FIG. 1, includes the ignition coil 2 and the igniter I. The ignition coil 2 is made up of the primary winding 21 and the secondary winding 22. The igniter I works to electrically energize the ignition coil 2. The ignition coil 2 works to create an increase or decrease in electrical current flowing through the primary winding 21 to develop an igniting high-voltage at the secondary winding 22. The spark plug P is connected to a high-voltage side of the secondary winding 22. "Connection", as referred to in this disclosure, means electrical connection unless otherwise specified.

The igniter I includes the switching circuit 30 equipped with the switching device 3 and the control circuit 30 working to control delivery of electrical current to the switching device 3. The switching device 3 is connected to an end of the primary winding 21. The control circuit 4 is responsive to an energization control signal in the form of the ignition signal IGt to control electrical energization of the switching device 3 to control an ignition operation. The control circuit 4 is equipped with the overvoltage protection circuit 5 which monitors voltage inputted to the primary winding 21 in order to protect the switching device 3 from being damaged.

Figure 2:
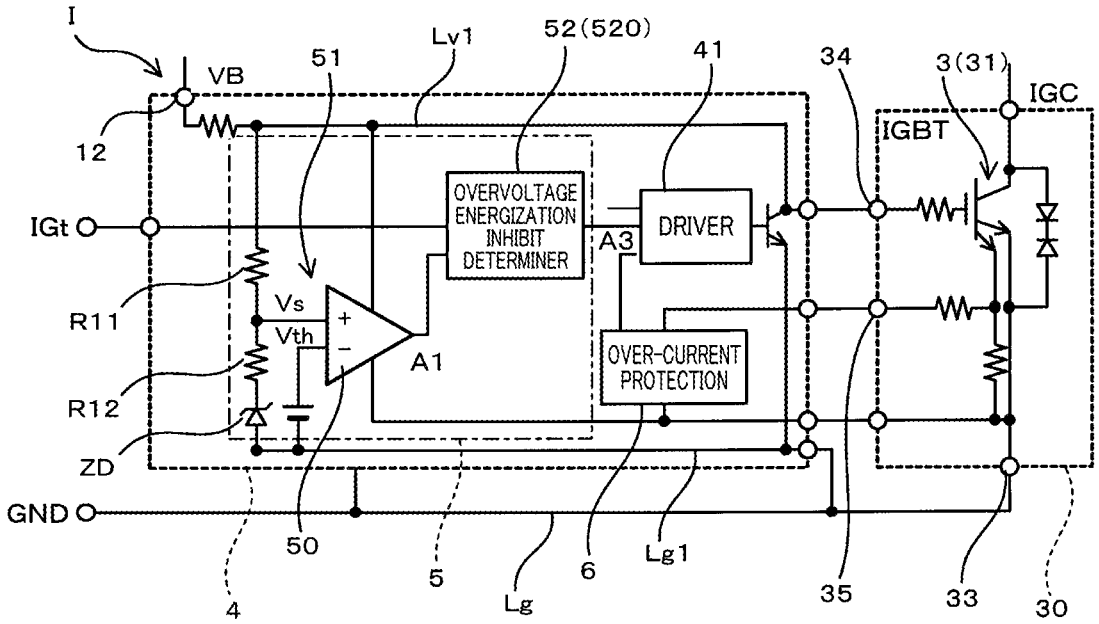
FIG. 2 is a circuit diagram which illustrates an igniter installed in the ignition device in FIG. 1.

The overvoltage protection circuit 5 of the control circuit 4, as can be seen in FIG. 2, monitors the voltage inputted to the primary winding 21 and outputs an energization inhibit signal A3 to block the flow of electrical current to the switching device 3 when a level of the monitored voltage (which will also be referred to as voltage level Vs) enters out of an overvoltage threshold level Vth. However, when the voltage level Vs, as demonstrated in FIG. 3B, exceeds the overvoltage threshold level Vth during output of the ignition signal IGt, the overvoltage protection circuit 5 stops outputting the energization inhibit signal A3 until a period of time for which the ignition signal IGt is outputted expires.

The overvoltage protection circuit 5 is designed to be enabled to output the energization inhibit signal A3 when the voltage level Vs exceeds the overvoltage threshold level Vth while the ignition signal IGt is not being outputted.

As apparent from the above discussion, the overvoltage protection circuit 5 analyzes not only the level of voltage inputted to the primary winding 21, but also output of the ignition signal IGt in determination of whether the energization inhibit signal A3 should be outputted. This inhibits the energization inhibit signal A3 from being outputted even when the voltage level Vs exceeds the overvoltage threshold level Vth during output of the ignition signal IGt, thereby ensuring the stability in performing the ignition operation at a required time in response to the ignition signal IGt without unexpected events of ignition.

The overvoltage protection circuit 5 preferably includes the overvoltage detector 51 and the energization enable determiner 520. The overvoltage detector 51 works to output the overvoltage signal A1. The energization enable determiner 520 works to output the energization enable signal A2. Specifically, the overvoltage detector 51 outputs the overvoltage signal A1 when the voltage level Vs is higher than the overvoltage threshold level Vth. The energization enable determiner 520 outputs the energization enable signal A2 when the ignition signal IGt has started to be outputted in a period of time in which the overvoltage signal A1 is not outputted or when the overvoltage signal A1 is stopped from being outputted in a period of time in which the ignition signal IGt is being outputted.

The overvoltage protection circuit 5 determines whether the energization inhibit signal A3 should be outputted depending upon a determination of whether the energization enable signal A2 is being outputted. Specifically, the overvoltage protection circuit 5 inhibits the energization inhibit signal A3 from being outputted in a period of time in which the energization enable signal A2 is being outputted. This causes the energization inhibit signal A3 to be outputted at desired times.

The control circuit 4 is equipped with the overcurrent protection circuit 6 which monitors the current I flowing through the switching device 3 and control the current I to be kept below the current limit I1.

The structure and operation of the ignition device 1 for internal combustion engines will be described below in detail.

The internal combustion engine, as referred to in this disclosure, is implemented by, for example, an engine for automobiles. When the spark plug P is activated by the ignition device 1, it will cause an air-fuel mixture in a combustion chamber of the engine, not shown, to be ignited and burned. The operation of the engine is controlled by an engine electronic control unit, not shown, which will be referred to below as engine control unit (ECU). The ECU outputs the ignition signal IGt (i.e., the energization control signal) to achieve the ignition operation of the ignition coil 2. The igniter I is responsive to the ignition signal IGt inputted to the input terminal 11 of the control circuit 4 to turn on the switching device 3 to control energization of the ignition coil 2.

The ignition coil 2 has the power conductor Lv connected to a first end of the primary winding 21, so that it is supplied with electrical power from a power source, not shown, through a main power supply terminal +B. The primary winding 21 is connected at a second end thereof to the switching device 3 through a coil-side terminal IGC of the switching circuit 30. The power source may be implemented by a battery mounted in the vehicle. The ignition coil 2 applies high-voltage, as developed at the secondary winding 22 upon stop of energization of the primary winding 21, between electrodes of the spark plug P, thereby creating an electrical spark.

The secondary winding 22 is connected at a low-voltage side thereof to the grounding conductor 24 through the on-duration spark inhibition diode 23. The on-duration spark inhibition diode 23 is connected at an anode thereof to the secondary winding 22 and at a cathode thereof to the ground. In other words, the on-duration spark inhibition diode 23 is oriented to have a forward direction toward the ground, thereby controlling a direction of flow of electrical current through the ignition coil 2 to inhibit sparks from being developed by voltage during turning on of the ignition coil 2.

The igniter I is equipped with the switching circuit 30 made of a single semiconductor chip into which the switching device 3 and the temperature measuring device 32 are integrated. The temperature measuring device 32 outputs a device temperature signal as a function of the temperature of the switching device 3. The switching device 3 is made of a known power transistor, specifically, an IGBT (Insulated Gate Bipolar Transistor) 31. The IGBT 31 is connected at a collector thereof to the coil-side terminal IGC and at an emitter thereof to the grounding conductor Lg through the grounding terminal 33 of the switching circuit 30. The grounding conductor Lg is connected to an external ground through the grounding terminal GND.

The temperature measuring device 32 is made of the temperature sensitive diodes D1 and D2 which are oriented in the forward direction and connected in series with each other. The temperature sensitive diodes D1 and D2 develop voltage between ends thereof which correlates with temperature thereof when an electrical current flows through the temperature sensitive diodes D1 and D2 in the forward direction. The temperature sensitive diodes D1 and D2, therefore, generate a level of voltage which indicates the temperature of the switching circuit 30 identical with that of the switching device 3. The temperature sensitive diodes D1 and D2 of the temperature measuring device 32 are connected at anodes thereof to a temperature-measuring terminal TSD and at cathodes thereof to ground. The forward direction in the temperature sensitive diodes D1 and D2 is from the anode to the cathode (i.e., ground).

The control circuit 4 is made of a monolithic IC (MIC), that is, a single semiconductor chip (which will also be referred to below as a control semiconductor chip) into which the drive circuit 41, the filter circuit 42, the overvoltage protection circuit 5, the overcurrent protection circuit 6, and the lock release circuit 43 are integrated. The filter circuit 42 works to shape a waveform of the ignition signal IGt outputted from the ECU to produce a binary signal, "high" or "low", which is in turn outputted to the drive circuit 41. The drive circuit 41 is connected to a gate of the IGBT 31 through the gate terminal 34 of the switching circuit 30 and works to output an energization signal to the IGBT 31 in response to the signal inputted from the filter circuit 42. This causes the voltage at the gate of the IGBT 31 to be switched to a high level or a low level to turn on or off the ignition coil 2.

The lock release circuit 43 works to execute an overtemperature protection operation to avoid an undesirable rise in temperature of the switching device 3 arising from overheat thereof, for example, during an operation in which the switching device 3 is locked in the on-state. For instance, such an operation is when the ignition signal IGt is kept at the on-level to continue to energize the switching device 3 or a high-speed and high-duty control operation in which the on-duration of the switching device 3 is long, while the cycle in which the switching device 3 is energized is short. When detecting a significant increase in temperature of the switching device 3, the lock release circuit 43 outputs an overheat signal to the drive circuit 41 to block delivery of electrical power to the switching device 3 (which will be referred to thermal shutdown), thereby protecting the switching device 3 from malfunction, such as breakdown, due to the overheat thereof.

For instance, the lock release circuit 43 includes a constant current source connected to the power supply terminal 12 and an overheat detector working to detect the overheat of the switching device 3. The overheat detector is made of, for example, a comparator with hysteresis. When the temperature of the switching device 3 is between a stop threshold voltage corresponding to a preselected energization stop temperature and a stop-cancelling threshold voltage, the lock release circuit 43 outputs the overheat signal to control energization of the switching device 3.

The overvoltage protection circuit 5, as will be described later in detail, is connected to the power conductor Lv through the power supply terminal 12. The overvoltage protection circuit 5 monitors a power supply voltage inputted from the power conductor Lv to the primary winding 21 of the ignition coil 2 and protects the switching circuit 30 from overvoltage arising from a variation in the power supply voltage. Usually, disconnection of a wire leading to the battery or a terminal of the battery during charging of the battery will result in a load dump surge, which increases the voltage at the power conductor Lv. Execution of the ignition operation during such surge voltage will result in conduction between a power supply side and a grounding side of the switching circuit 30, thereby creating an electrically conductive path indicated by a broken line in FIG. 1 in which a large amount of current will flow due to the overvoltage. This leads to a risk of thermal breakage of the switching device 3.

In order to alleviate the above problem, when the level of voltage appearing at the power conductor Lv connected to the primary winding 21 is monitored and then determined to be overvoltage, the overvoltage protection circuit 5 blocks the delivery of electrical power to the switching circuit 30 to prevent an overcurrent from flowing through the switching device 3. The overvoltage protection circuit 5 also works to determine whether the ignition signal IGt is being outputted to decide whether the delivery of electrical power to the switching circuit 30 should be blocked or permitted without inhibiting the electrical power from being supplied to the switching circuit 30 immediately when the overvoltage appears at the power conductor Lv, thereby minimizing adverse effects on the ignition operation.

The overcurrent protection circuit 6 is connected to the sense-emitter terminal 35 of the switching circuit 30 to measure the value of current I (which will also be referred to as energizing current I) flowing through the primary winding 21 of the ignition coil 2 and the switching device 3 during the on-state of the ignition signal IGt. The overcurrent protection circuit 6 works to keep the energizing current I below the preselected current limit I1 in order to protect the switching circuit 30 from overcurrent. The noise cancelling capacitor 13 may be disposed between the main power supply terminal +B and the ground terminal GND.

Referring to FIG. 2, the overvoltage protection circuit 5 includes the overvoltage detector 51 and the overvoltage de-energization determiner 52 equipped with the energization enable determiner 520. The overvoltage detector 51 is equipped with the voltage measuring resistors R11 and R12 and the comparator 50. The control circuit 4 has disposed therein the high-potential conductor Lv1 connected to the power supply terminal 12 and the low-potential conductor Lg1 connected to the grounding conductor Lg. The voltage measuring resistors R11 and R12 are connected in series with each other between the high-potential conductor Lv1 and the low-potential conductor Lg1 and work to output a signal as a function of the power supply voltage VB. The Zener diode ZD is disposed between the low-potential side voltage measuring resistor R2 and the low potential conductor Lg1.

The voltage level Vs appearing at a junction of the voltage measuring resistors R11 and R12 is inputted to a plus terminal of the comparator 50 as a measured voltage signal and compared with the overvoltage threshold level Vth inputted to a minus terminal of the comparator 50. The voltage level Vs is a fraction of the power supply voltage VB inputted from the power supply terminal 12 which emerges from the junction of the voltage measuring resistors R11 and R12. The comparator 50 outputs a high-level signal or a low-level signal based on comparison of the voltage level Vs and the overvoltage threshold level Vth. The overvoltage threshold level Vth is used to determine whether the power supply voltage VB is an overvoltage and predetermined based on a relationship between the power supply voltage VB and the voltage level Vs.

The comparator 50 changes an output therefrom at a time when the measured voltage level Vs exceeds the overvoltage threshold level Vh to output the overvoltage signal A1 of the high-level to the overvoltage de-energization determiner 52. The overvoltage de-energization determiner 52 analyzes input of the overvoltage signal A1 from the comparator 50 and input of the ignition signal IGt to determine whether the switching circuit 30 needs to be de-energized due to the overvoltage.

When determining that it is necessary to de-energize the switching circuit 30, the overvoltage de-energization determiner 52 outputs the energization inhibit signal A3 to the drive circuit 41 to inhibit the gate signal from being outputted to the gate terminal 34 of the switching circuit 30. The structure of the overvoltage de-energization determiner 52 will be described below in detail. FIG. 2 illustrates only a highlight of the control circuit 4 which includes the overvoltage protection circuit 5 and a peripheral circuit for controlling the energization of the switching device 3.

Figure 3A:
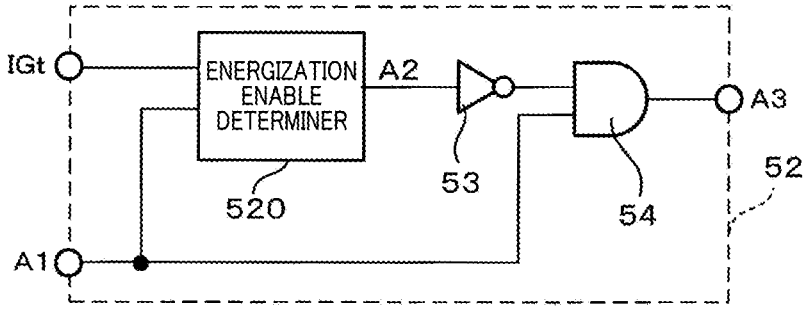
FIG. 3A is a circuit diagram which illustrates a structure of an overvoltage de-energization determiner installed in an igniter in the first embodiment.

The overvoltage de-energization determiner 52, as clearly illustrated in FIG. 3A, includes the energization enable determiner 520, the inverter circuit 53, and the AND circuit 54. The energization enable determiner 520 outputs the energization enable signal A2 based on the ignition signal IGt and the overvoltage signal A1. The inverter circuit 53 is arranged between the energization enable determiner 520 and the AND circuit 54 and works to invert an output of the energization enable determiner 520 and input it to one of terminals of the AND circuit 54. The other terminal of the AND circuit 54 is connected to an input terminal to which the overvoltage signal A1 is inputted.

The AND circuit 54 continues to output the energization inhibit signal A3 only when the energization enable determiner 520 is not outputting the energization enable signal A2, and the overvoltage signal A1 is being inputted to the AND circuit 54. In other words, the AND circuit 54 is inhibited from outputting the energization inhibit signal A3 as long as the energization enable signal A2 is being outputted from the energization enable determiner 520 even when the overvoltage signal A1 is being inputted to the AND circuit 54. The AND circuit 54 is permitted to output the energization inhibit signal A3 when the overvoltage signal A1 is being inputted to the AND circuit 54, and the energization enable signal A2 is stopped from being outputted to the AND circuit 54. However, the AND circuit 54 does not output the energization inhibit signal A3 when the overvoltage signal A1 is not being inputted to the AND circuit 54 regardless of whether the energization enable signal A2 is being outputted to the AND circuit 54.

Figure 3B:
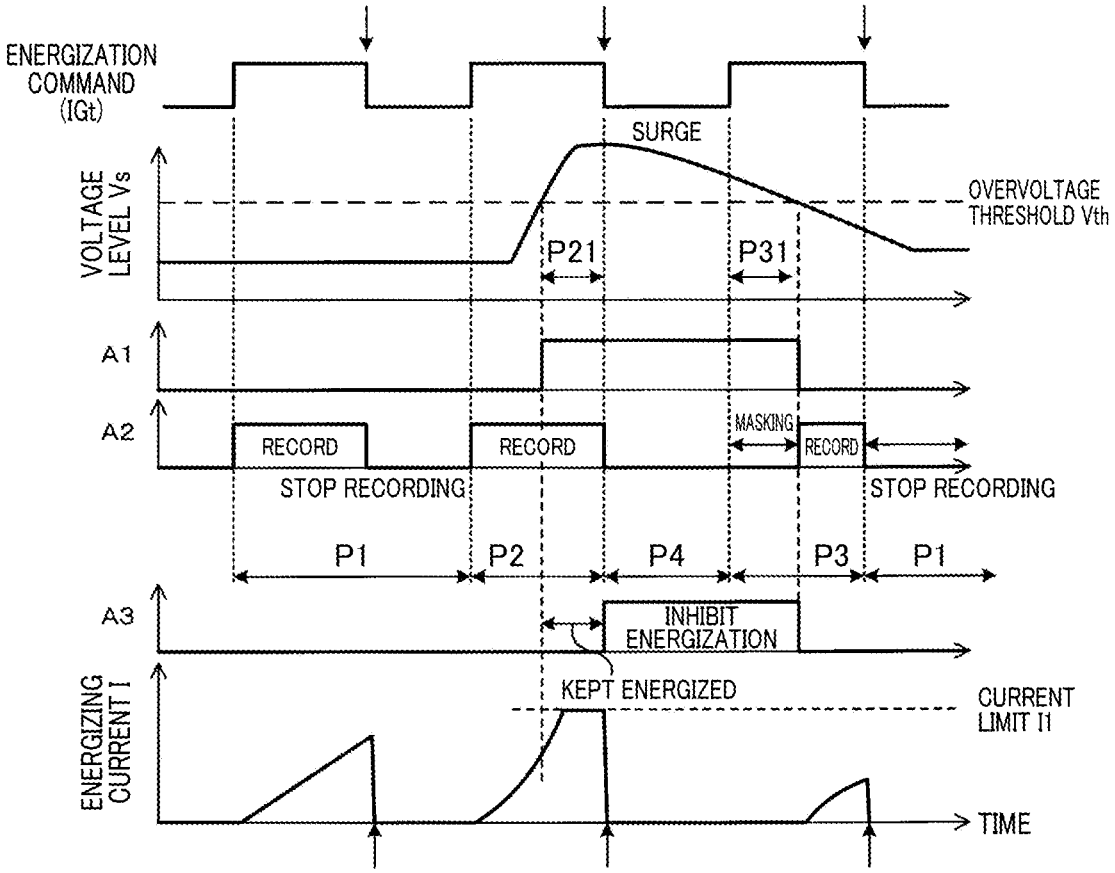
FIG. 3B is a time chart which demonstrates an overvoltage protection operation executed by an overvoltage protection circuit in the first embodiment.

The energization enable determiner 520 is, as can be seen in FIG. 3B, basically designed to output the energization enable signal A2 based on a record of output of the ignition signal IGt, but masks, as clearly illustrated in FIG. 3B, a portion of the record based on whether the overvoltage signal A1 is being outputted and the time when the overvoltage signal A1 is being outputted. The overvoltage de-energization determiner 52 continues to output the energization inhibit signal A3 for a period of time when the overvoltage signal A1 is being outputted except for a period of time when the energization enable determiner 520 is outputting the energization enable signal A2. For a period of time in which the energization inhibit signal A3 is being outputted from the overvoltage de-energization determiner 52, the ignition operation is inhibited from being executed regardless of the ignition signal IGt. In other words, the switching device 3 is permitted to be energized only for a period of time in which the energization enable signal A2 is being outputted from the energization enable determiner 520.

The time for which the energization enable signal A2 is outputted to permit the switching circuit 30 to be energized is selected in order to minimize adverse effects of the overvoltage on the switching device 3 and eliminate a risk that the ignition operation may be executed at an undesirable time. Specifically, the energization enable determiner 520 starts to permit the switching circuit 30 to be energized in response to the ignition signal IGt when the overvoltage signal A1 is not outputted and continues such permission until a period of time for which the ignition signal IGt is outputted expires. Further, when the ignition signal IGt is outputted during output of the overvoltage signal A1, the energization enable determiner 520 masks a portion of output of the ignition signal IGt. Subsequently, at a time when the overvoltage signal A1 is stopped from being outputted, the energization enable determiner 520 enables the ignition signal IGt to be used to permit the switching circuit 30 to be energized until the ignition signal IGt is stopped from being outputted. In other words, the energization enable determiner 520 continues to output the energization enable signal A2 for a period of time in which the ignition signal IGt is outputted except when the overvoltage signal A1 is being already outputted before the ignition signal IGt starts to be outputted.

A period of time P1 when the power supply voltage VB is at a normal level and periods of time P2, P3, and P4 when the power supply voltage VB at a level of overvoltage will be described below in terms of output of various types of signals and the ignition operation. Specifically, when the overvoltage signal A1 is not outputted (i.e., the period of time P1), the energization enable determiner 520 outputs the energization enable signal A2 for a period of time corresponding to a period of time for which the ignition signal IGt is outputted. Note that each of the overvoltage signal A1, the energization enable signal A2, and the energization inhibit signal A3 is a binary signal, "high" or "low", and the term "output", as referred to herein, means output of the high level signal.

Once the overvoltage signal A1 is outputted, the energization enable determiner 520 continues or starts to output the energization enable signal A2 only when the ignition signal IGt had started to be outputted while the overvoltage signal A1 was not being outputted (i.e., for the period of time P2) or after the overvoltage signal A1 is stopped from being outputted during output of the ignition signal IGt (i.e., for the period of time P3). After starting outputting the energization enable signal A2, the energization enable determiner 520 continues to output it as long as the ignition signal IGt is outputted. For a period of time when the overvoltage signal A1 is being outputted, but the ignition signal IGt is not outputted (i.e., for the period of time P4), the energization inhibit signal A3 continues to be outputted.

The ignition signal IGt that is an energization command is outputted from the ECU in the form of a rectangular wave signal prior to ignition timings indicated by arrows in FIG. 3B. The voltage level Vs measured by the overvoltage detector 51 in the period of time P1 is lower than the overvoltage threshold level Vth. The overvoltage signal A1 is, therefore, kept at the low level. The energization enable signal A2 has the same waveform as that of the ignition signal IGt in a period of time when the overvoltage signal A1 is not outputted. Specifically, the energization enable signal A2 becomes the high level upon arising of the ignition signal IGt and is then kept at the high level until the ignition signal IGt falls in level. In such a period of time, the overvoltage signal A1 of the low level is inputted to the AND circuit 54, so that the AND circuit 54 does not output the energization inhibit signal A3 regardless of the level of the energization enable signal A2.

Upon rising of the ignition signal IGt, the control circuit 4 starts to energize the switching device 3, so that the energizing current I rises. Subsequently, the switching device 3 is de-energized upon falling of the ignition signal IGt, so that the energizing current I rapidly decreases, thereby causing high-voltage, as developed at the secondary winding 22, to be applied to the spark plug P. In this case, the ignition operation is performed at a correct ignition timing in response to the ignition signal IGt. Upon falling of the ignition signal IGt, the recording of output of the ignition signal IGt is stopped. The energization enable signal A2 is then set to the low level.

The period of time P2 demonstrated in FIG. 3B is a period of time in which the ignition signal IGt is outputted while the power supply voltage VB is kept at an increased level after being raised by a high voltage surge thereof during output of the ignition signal IGt following the period of time P1. When the high voltage surge is inputted to the switching device 3 after being energized, for example, in the period of time P2, the ignition operation is preferentially executed. Alternatively, when the high voltage surge is inputted to the switching device 3 when the switching device 3 is not yet energized, the switching device 3 is preferentially protected from the voltage surge.

In the period of time P2, the voltage level Vs at the time of rising of the ignition signal IGt is lower than the overvoltage threshold level Vth. The overvoltage signal A1 is, therefore, kept at the low level. The energization enable signal A2 has the same waveform as that of the ignition signal IGt, so that it becomes the high level in response to rising of the ignition signal IGt. Afterwards, when the power supply voltage VB is raised by a high voltage surge, and the voltage level Vs exceeds the overvoltage threshold level Vth (e.g., in the period of time P21 in FIG. 3B), the overvoltage signal A1 is changed to the high level. The energization enable signal A2 is, however, kept at the high level, thereby still stopping the energization inhibit signal A3 from being outputted. This keeps the switching device 3 energized. Upon falling of the ignition signal IGt, the supply of electrical power to the switching device 3 is cut.

When the ignition signal IGt is being outputted, the ignition operation is preferentially executed, so that the spark plug P is activated at a correct timing, thereby eliminating a risk that the engine is damaged by accidental ignition, e.g., pre-ignition. In a period of time when the overvoltage signal A1 is kept at the high level, the switching device 3 is energized at overvoltage, but however, the energizing current I is controlled to be kept below the current limit I1 set by the overcurrent protection circuit 6 (see FIG. 1), thus enabling the ignition operation to be executed while minimizing the heating of the switching device 3.

When the ignition operation is completed in the period of time P2 after which the energization enable signal A2 is changed to the low level at the time of falling of the ignition signal IGt, the AND circuit 54 has inputs of the overvoltage signal A1 of the high level and the inverse of the energization enable signal A2 of the low level in the following period of time P4. This causes an output of the AND circuit 54 to be changed from the low level to the high level, so that the energization inhibit signal A3 is outputted. Subsequently, in the period of time P3, when the ignition signal IGt is outputted while the energization inhibit signal A3 is being outputted, the energization inhibit signal A3 is kept outputted. In other words, since the overvoltage has appeared before output of the ignition signal IGt, the energization inhibit signal A3 is permitted to be outputted.

The voltage level Vs before the ignition signal IGt rises in the period of time P3 is higher than the overvoltage threshold level Vth. The overvoltage signal A1 is kept at the high level. In such a condition, when the ignition signal IGt is outputted, the energization enable signal A2 is kept at the low level, in other words, is not outputted by the above described masking operation of the energization enable determiner 520 until the overvoltage disappears (i.e., for the period of time P31 in FIG. 3B). The AND circuit 54, therefore, has inputs of the overvoltage signal A1 of the high level and the inverse of the energization enable signal A2 of the low level. This causes the energization inhibit signal A3 to be kept at the high level to inhibit the switching device 3 from being energized.

Afterwards, when the voltage level Vs drops below the overvoltage threshold level Vth, so that the overvoltage signal A1 is changed to the low level, the masking operation is terminated, thereby causing the energization enable signal A2 to be changed to the high level. The AND circuits 54, therefore, has inputs of the low level, thereby stopping outputting the energization inhibit signal A3. This resumes the energization of the switching device 3. Upon falling of the ignition signal IGt, the switching device 3 is deenergized.

In the above way, when the overvoltage signal A1 is being outputted, in other words, kept at the high level, the protection of the switching device 3 is preferential. The ignition operation is, therefore, masked until the overvoltage disappears, thereby avoiding flow of a large amount of current through the switching device 3.

Figure 4:
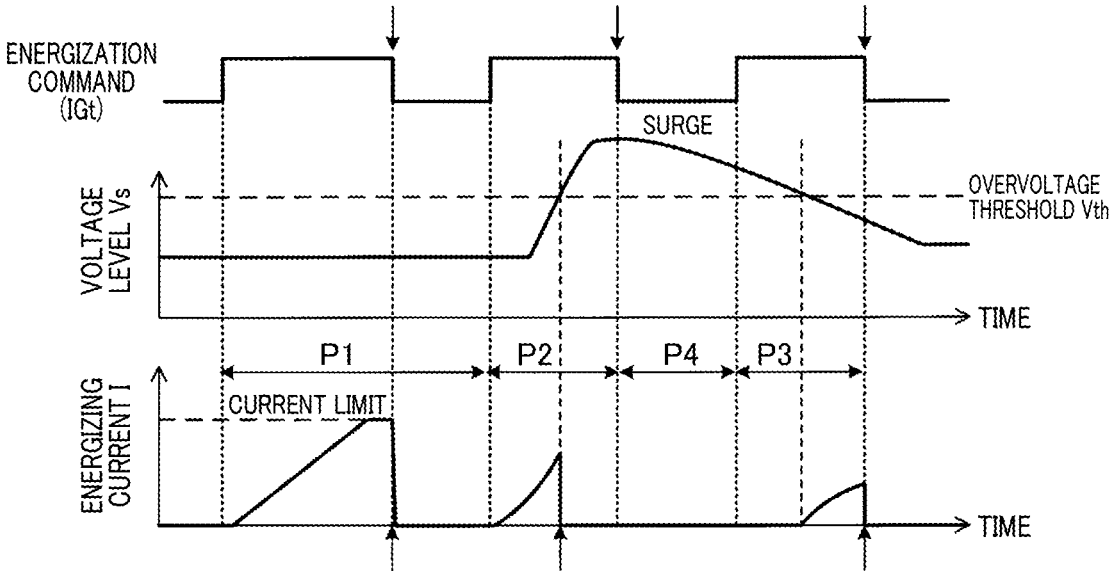
FIG. 4 is a time chart which demonstrates an overvoltage protection operation executed in a comparative example.

In a comparative example, as demonstrated in FIG. 4, where the overvoltage protection circuit 5 is designed not to have the overvoltage de-energization determiner 52, so that the timing of ignition instructed by the ignition signal IGt is not considered in controlling the energization of the switching device 3, the supply of the energizing current I is cut depending upon whether the voltage level Vs exceeds the overvoltage threshold level Vth. Accordingly, when the overvoltage occurs during output of the ignition signal IGt in the period of time P2, it immediately stops the energization of the switching device 3 to block the energizing current I, thereby causing the time of ignition to be advanced from a correct one. In the illustrated example, when an output duration of the ignition signal IGt becomes long, for example, in the period of time P1, the overcurrent protection circuit 6 works to execute an overcurrent protection operation to keep the energizing current I below the current limit I1.

Figure 5:
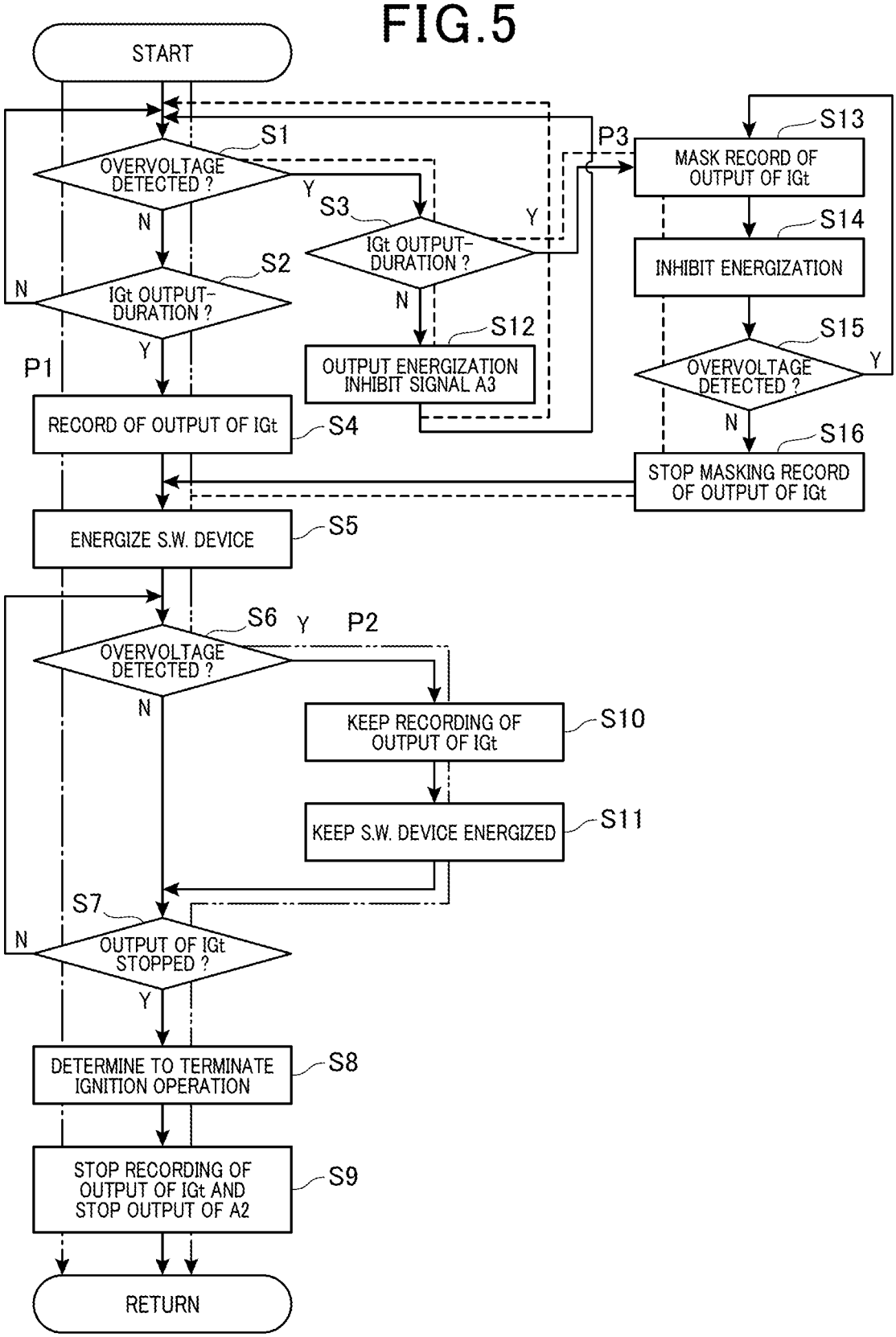
FIG. 5 is a flowchart of a sequence of steps to perform an ignition operation of a control circuit and an overvoltage protection operation of an overvoltage protection circuit in the first embodiment.

FIG. 5 illustrates a flowchart of a sequence of logical steps of the ignition operation which is performed by the control circuit 4 of the ignition device 1 and includes an operation to energize the switching device 3 based on the ignition signal IGt and an overvoltage protection operation of the overvoltage protection circuit 5. In FIG. 5, differences in operation performed in the periods of time P1 to P4 are indicated by directional lines. Operations in steps S1 to S3 logically constitute the energization enable determiner 520. First, in step S1, an output from the overvoltage detector 51 is used to determine whether the overvoltage has appeared, that is, whether the overvoltage signal A1 is at the high level or the low level. If a NO answer is obtained meaning that no overvoltage has occurred, then the routine proceeds to step S2. Alternatively, if a YES answer is obtained, then the routine proceeds to step S3. In step S2 or S3, it is determined whether the ignition signal IGt is being outputted, that is, whether the ignition signal IGt is at the high level.

At the beginning of the above described period of time P1 or P2, the ignition signal IGt that is not at an overvoltage level is outputted. An NO answer is, therefore, obtained in step S1. A YES answer is obtained in step S2. The routine then proceeds to step S4 wherein the ignition signal IGt is recorded as being outputted. The energization enable signal A2 is then outputted. When the energization enable signal A2 is outputted, the energization inhibit signal A3 is not simultaneously outputted. The routine then proceeds to step S5 wherein the energizing operation is started to deliver electrical power to the switching device 3 in response to the ignition signal IGt. If a NO answer is obtained in step S2, then the routine returns back to step S1.

After step 5, the routine proceeds to step S6 wherein an output of the overvoltage detector 51 is analyzed to determine whether the overvoltage has occurred. If a NO answer is obtained, then the routine proceeds to step S7 wherein it is determined whether the output of the ignition signal IGt is stopped, in other words, whether the ignition signal IGt has been changed to the low level. If a NO answer is obtained, then the routine returns back to step S6 to repeat the operation in step S6 until a YES answer is obtained in step S7. If a YES answer is obtained in step S6, then the routine proceeds to step S10.

In the above period of time P1, the overvoltage does not appear. A NO answer is, therefore, obtained in step S6. If a YES answer is obtained in step S7 meaning that the output of the ignition signal IGt is stopped, then the routine proceeds to step S8 wherein the switching device 3 is deenergized to cut the flow of the energizing current I to the primary winding 21. This causes a high-voltage to be developed at the secondary winding 22 and then applied to the spark plug P. Afterwards, the routine proceeds to step S9 wherein the recording of output of the ignition signal IGt is stopped, and the output of the energization enable signal A2 is stopped. The routine then returns back to step S1. The period of time P1 expires. In the above way, the ignition operation is executed at the desired timing.

In the above period of time P2, the operations in steps S1 to S6 are executed in the same way as in the period of time P1. When the overvoltage occurs in the period of time P2, a YES answer is obtained in step S6. The routine then proceeds to step S10 wherein the ignition signal IGt continues to be recorded as being outputted, in other words, the energization enable signal A2 is kept outputted. The routine proceeds to step S11 wherein the switching device 3 is kept energized. Afterwards, the routine proceeds to step S7. This causes a NO answer to continue to be obtained in step S7 to repeat the operation in step S6 until the period of time P2 expires without stopping the output of the energization enable signal A2 even when the overvoltage occurs in the period of time P2.

If a YES answer is obtained in step S7, then the routine proceeds to step S8 wherein it is determined that the ignition operation should be performed in the same way as in the period of time P1. The routine proceeds to step S9 wherein the recording of output of the ignition signal IGt is stopped, and the output of the energization enable signal A2 is stopped. The routine then returns back to step S1. The period of time P2 expires. In the above way, the ignition operation is executed at the desired timing.

At the beginning of the period of time P3 or P4, the voltage level Vs (i.e., the power supply voltage VB) is at the level of overvoltage. A YES answers is, therefore, obtained in step S1. The routine then proceeds to step S3 wherein it is determined whether the ignition signal IGt is being outputted, in other words, whether the ignition signal IGt is at the high level. If a NO answer is obtained in step S3, then the routine proceeds to step S12. Alternatively, if a YES answer is obtained in step S3, then the routine proceeds to step S13. In the period of time P4, the ignition signal IGt is not outputted. The routine, therefore, proceeds to step S12 wherein the energization inhibit signal A3 is outputted to inhibit the switching device 3 from being energized. The routine then returns back to step S1.

In the period of time P3, the ignition signal IGt is being outputted. A YES answer is, therefore, obtained in step S3. The routine then proceeds to step S13 wherein the record of output of the ignition signal IGt is masked. The routine proceeds to step S14 wherein the energization inhibit signal A3 is outputted to inhibit the switching device 3 from being energized. The routine proceeds to step S15 wherein an output of the overvoltage detector 51 is analyzed to determine whether the overvoltage has occurred. If a YES answer is obtained in step S15, then the routine returns back to step S13.

When the overvoltage disappears in the period of time P3, a NO answer is obtained in step S15. The routine then proceeds to step S16 wherein the masking of the record of output of the ignition signal IGt is terminated. In other words, the recording of output of the ignition signal IGt is resumed to output the energization enable signal A2 and stop the output of the energization inhibit signal A3. The routine then proceeds to step S5 wherein the switching device 3 starts to be energized. The routine proceeds to step S6. The ignition operation is then performed in the same way as in the period of time P1 or P2. The period of time P3 then expires.

In the above way, the record of output of the ignition signal IGt is masked at the beginning of the period of time P3 to output the energization inhibit signal A3, thereby inhibiting the switching device 3 from being energized. Afterwards, the recording of output of the ignition signal IGt is resumed to output the energization enable signal A2, thereby starting energization of the switching device 3. The ignition operation is, therefore, performed at a correct timing.

Second Embodiment

The ignition device 1 for internal combustion engines according to the second embodiment will be described below with reference to FIGS. 6 and 7. The circuit structures of the ignition device 1 and the igniter I are basically identical with those illustrated in FIGS. 1 to 3B, and explanation thereof using drawings will be omitted here. The following discussion will refer to the structure of the overvoltage de-energization determiner 52 of the overvoltage protection circuit 5 and the overvoltage protection operation of the overvoltage protection circuit 5. Parts of the second embodiment which are different from those in the first embodiment will mainly be discussed below.

Reference numbers in the second and following embodiments which are the same as those in the first embodiment will refer to the same parts unless otherwise specified.

Figure 6:
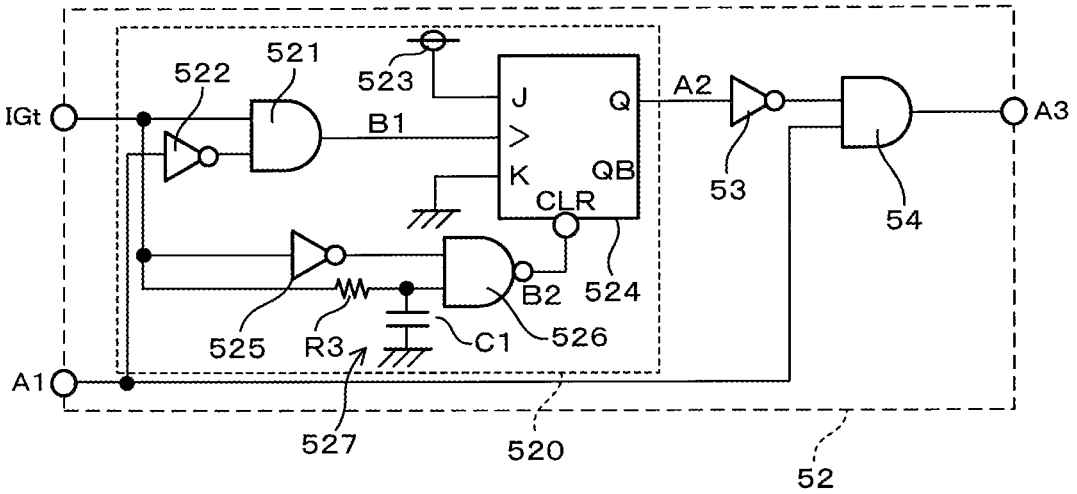
FIG. 6 is a circuit diagram which illustrates an overvoltage de-energization determiner installed in an igniter in the second embodiment.

Like in the first embodiment, the overvoltage de-energization determiner 52, as illustrated in FIG. 6, includes the energization enable determiner 520, the inverter circuit 53, and the AND circuit 54. The energization enable determiner 520 works to output the energization enable signal A2 in response to the ignition signal IGt and the overvoltage signal A1. The inverter circuit 53 inverts an output from the energization enable determiner 520 and inputs it to the input terminals of the AND circuit 54. The overvoltage signal A1 is inputted to the second input terminal of the AND circuit 54.

When an output of the overvoltage de-energization determiner 52 has the low level, in other words, the invert of that output is at the high level, and the overvoltage signal A1 is being outputted, the AND circuit 54 outputs the energization inhibit signal A3. The energization enable determiner 520 is, as described above, designed to analyze the ignition signal IGt and the overvoltage signal A1 to output the energization enable signal A2. The energization enable signal A2 is being outputted for a period of time to minimize adverse effects of the overvoltage on the switching device 3 and also eliminate a risk that the ignition operation may be executed at an unintentional timing.

Specifically, the energization enable determiner 520 includes the JK flip-flop 524 of a rising edge-triggered type, the AND circuit 521, the NAND circuit 526, the inverter circuits 522 and 525. The JK flip-flop 524 is connected at a clock terminal thereof to the AND circuit 521 and at a negative logic clear terminal CLR thereof to the NAND circuit 52. The AND circuit 521 is connected at a first terminal thereof to an input terminal to which the ignition signal IGt is inputted and at a second terminal thereof through the inverter circuit 522 to an input terminal to which the overvoltage signal A1 is inputted. The NAND circuit 526 is connected at a first terminal thereof through the inverter circuit 525 to the input terminal for the ignition signal IGt and at a second terminal thereof through the delay circuit 527 to the input terminal for the ignition signal IGt.

When the ignition signal IGt is inputted and the overvoltage signal A1 is not inputted, in other words, the inverse of the overvoltage signal A1 is at the high level, the AND circuit 521 outputs the energization enable duration signal B1. Alternatively, when either or both of the ignition signal IGt and the inverse of the overvoltage signal A1 are changed to the low level, in other words, when the ignition signal IGt is not outputted or the overvoltage disappears, the AND circuit 521 inhibits output of the energization enable duration signal B1.

The JK flip-flop 524 has the J-terminal which is connected to a power supply and to which an electrical potential corresponding to the high level is inputted. The JK flip-flop 524 also has the K-terminal connected to ground. When the energization enable duration signal B1 is inputted as a trigger to the clock terminal of the JK flip-flop 524, the JK flip-flop 524 latches an input to the J-terminal and outputs it from the Q-terminal. In other words, when the energization enable duration signal B1 rises, it will cause the energization enable signal A2 to be outputted form the Q-terminal. The energization enable signal A2 continues to be outputted until the reset signal B2 is inputted to the clear terminal CLR to stop the recording of output of the ignition signal IGt.

The NAND circuit 526 has an input of the inverse in level of the ignition signal IGt to the first terminal thereof and also has an input of a delay signal to the second terminal thereof which is produced with a given delay set by the delay circuit 527 after output of the ignition signal IGt. The voltage appearing at the first terminal of the NAND circuit 526 has the high level when the ignition signal IGt is not inputted thereto, while that appearing at the second terminal of the NAND circuit 526 has the high level when the delay signal of the ignition signal IGt is inputted to the second terminal. In other words, the reset signal B2 outputted from the NAND circuit 526 has the high level when the ignition signal IGt is outputted or the delay signal is not outputted, while it has the low level when only the delay signal is inputted to the NAND circuit 526 following an output duration of the ignition signal IGt.

In the above way, each time the output duration of the ignition signal IGt expires, the output from the Q-terminal of the NAND circuit 526 is reset by the reset signal B2. When the ignition signal IGt is subsequently outputted, the energization enable signal A2 is enabled again to be outputted in response to rising of the energization enable duration signal B1. In other words, the energization enable duration signal B1 is a signal to define a period of time for which the overvoltage signal A1 is not outputted within the output duration when the ignition signal IGt is outputted, that is, determine the time when the energization enable signal A2 should be raised in level. The time when the energization enable signal A2 should fall in level is determined by the reset signal B2.

Figure 7:
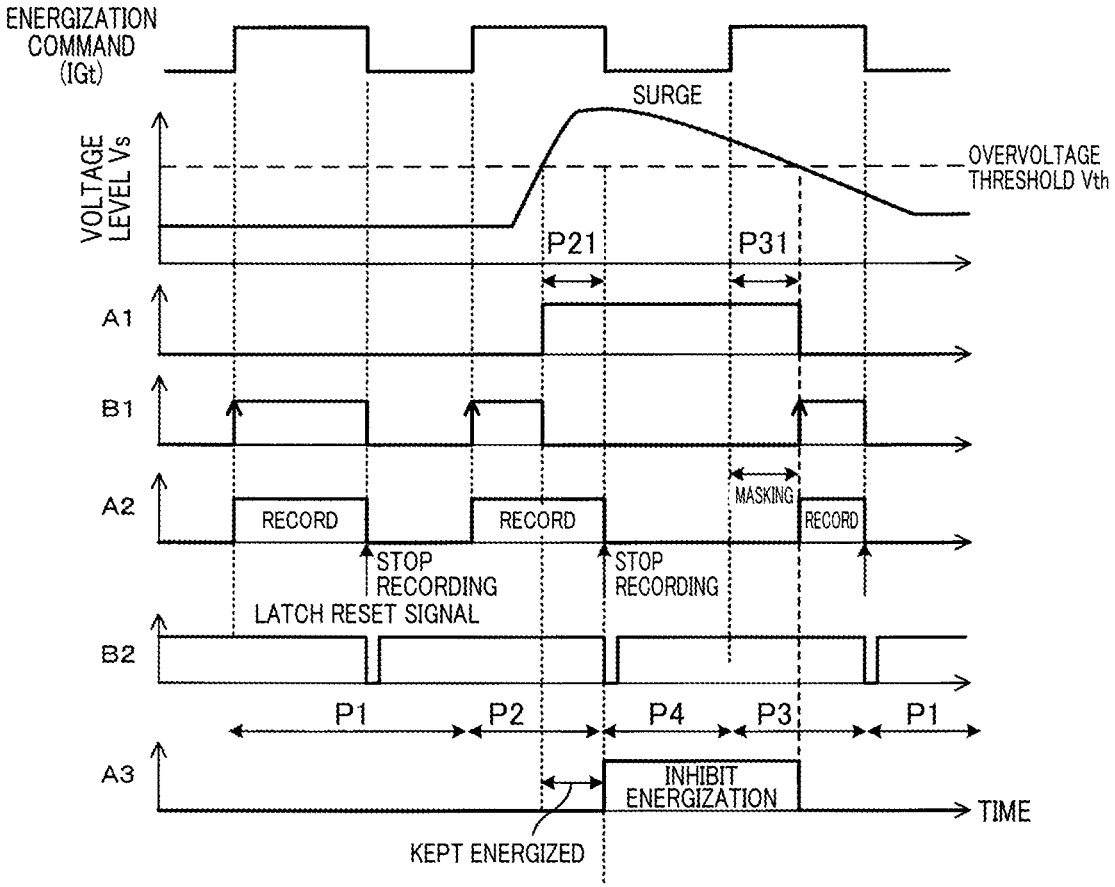
FIG. 7 is a timing chart which demonstrates an overvoltage protection operation of an overvoltage protection circuit in the second embodiment.

FIG. 7 is a time chart which represents the energization enable duration signal B1 and the reset signal B2 in addition to a relation among the ignition signal IGt, the overvoltage signal A1, the energization enable signal A2, and the energization inhibit signal A3 illustrated in FIG. 3B. FIG. 7 also show a relation among the period of time P1 in which the voltage level Vs is below the overvoltage threshold level Vth and the period of times P2 to P4 in which the overvoltage appears. A time-sequential change in the energizing current I in each of the periods of time P1 to P4 is identical with that in FIG. 3B and thus omitted here.

In the period of time P1, the voltage level Vs is lower than the overvoltage threshold level Vth, and the overvoltage signal A1 is kept at the low level. The AND circuit 54 of the overvoltage de-energization determiner 52, thus, does not output the energization inhibit signal A3. A high-level inversion of the overvoltage signal A1 continues to be inputted to the AND circuit 521 of the energization enable determiner 520 of the AND circuit 521. Upon input of the ignition signal IGt, the AND circuit 521 changes the energization enable duration signal B1 to the high level and outputs it. Upon input of the energization enable duration signal B1 from the AND circuit 521 to the clock terminal of the JK flip-flop 524, the energization enable signal A2 is outputted from the Q-terminal of the JK flip-flop 524. The output of the energization enable signal A2 is recorded.

The reset signal B2 outputted from the NAND circuit 526 is kept at the high level for the output duration of the ignition signal IGt. Specifically, the delay signal is at the low level before output of the ignition signal IGt. The inversion in level of the ignition signal IGt is at the low level after the output of the ignition signal IGt. In the period of time P1, when the inverse of the ignition signal IGt is changed to the high level while the delay signal is kept at the high level, the reset signal B2 is changed to the low level. When the reset signal B2, as changed to the low level, is inputted to the clear terminal of the JK flip-flop 524, the recording of output of the energization enable signal A2 form the Q-terminal of the JK flip-flop 524 is stopped.

In the period of time P2, the voltage level Vs changes in the same way as in the period of time P1 until the power supply voltage VB is raised by the surge voltage in the output duration of the ignition signal IGt. The overvoltage signal A1 is, therefore, kept at the low level. The energization inhibit signal A3 is not outputted. Upon input of the ignition signal IGt, the AND circuit 521 outputs the energization enable duration signal B1, so that the energization enable signal A2 is changed to the high level. Afterwards, when the measured voltage level Vs exceeds the overvoltage threshold level Vth (i.e., in the period of time P21 in FIG. 7), an inversion in level of the overvoltage signal A1 inputted to the AND circuit 521 of the energization enable determiner 520 is changed to the low level, thereby stopping outputting the energization enable duration signal B1. The output from the Q-terminal of the JK flip-flop 524 is, however, kept as it is, so that the energization enable signal A2 is kept at the high level to continue to energize the switching device 3 until the output duration of the ignition signal IGt expires.

As apparent from the above discussion, when the ignition signal IGt is outputted, after which high surge is inputted to the ignition device 1, the ignition operation is preferentially executed, so that the spark plug P is activated at a set timing. Like in the first embodiment, the energizing current I is controlled below the current limit I1, thereby protecting the switching device 3 from the surge and avoiding damage to the engine.

Upon expiry of the output duration of the ignition signal IGt in the period of time P2, the recording of output of the ignition signal IGt is, like in the period of time P1, stopped in response to the reset signal B2 outputted from the NAND circuit 526, so that the energization enable signal A2 is changed to the low level. In the following period of time P4, the ignition signal IGt is not outputted. The AND circuit 521, therefore, does not output the energization enable duration signal B1, so that the energization enable signal A2 is kept at the low level. The reverse of the energization enable signal A2 inputted to the AND circuit 54 is, therefore, at the high level. The overvoltage signal A1 is also at the high level. This causes the AND circuit 54 to continue to output the energization inhibit signal A3.

In the following period of time P3, when the ignition signal IGt is outputted while the high surge is being inputted to the ignition device 1, the inverse of the overvoltage signal A1 inputted to the AND circuit 521 of the energization enable determiner 520 is kept at the low level as long as the overvoltage signal A1 is at the high level (i.e., in the period of time P31 in FIG. 7). The inverse of the overvoltage signal A1 inputted to the AND circuit 521 of the energization enable determiner 520 is, therefore, at the low level, the AND circuit 521 does not output the energization enable duration signal B1. This masks output of the energization enable signal A2 from the JK flip-flop 524, so that the inversion in level of the energization enable signal A2 is changed to the high level. The overvoltage signal A1 is still at the high level. The AND circuit 54, therefore, outputs the energization inhibit signal A3 which is still at the high level.

Afterwards, when the voltage level Vs becomes below the overvoltage threshold level Vth, so that the overvoltage signal A1 is changed to the low level, the masking operation is stopped to change the energization enable signal A2 to the high level. The AND circuit 54, therefore, generates an output of the low level, thereby stopping outputting the energization inhibit signal A3. In this way, when the overvoltage is occurring, the ignition device 1 works to preferentially protect the switching device 3 from the overvoltage without executing the ignition operation regardless of output of the ignition signal IGt, thereby avoiding flow of a large amount of electrical current through the switching device 3.

Third Embodiment

The ignition device 1 for internal combustion engines according to the third embodiment will be described below with reference to FIGS. 8 to 13. The circuit structure of the ignition device 1 is basically identical with that illustrated in the first embodiment, and illustration thereof will be omitted here. The igniter I in this embodiment includes the current limit correcting circuit 61 which works to variably determine the current limit I1 in the overcurrent protection circuit 6. The overcurrent protection circuit 6 and the current limit correcting circuit 61 constitute the current limiting circuit 60. Parts of the third embodiment which are different from those in the first embodiment will mainly be discussed below.

Figure 8:
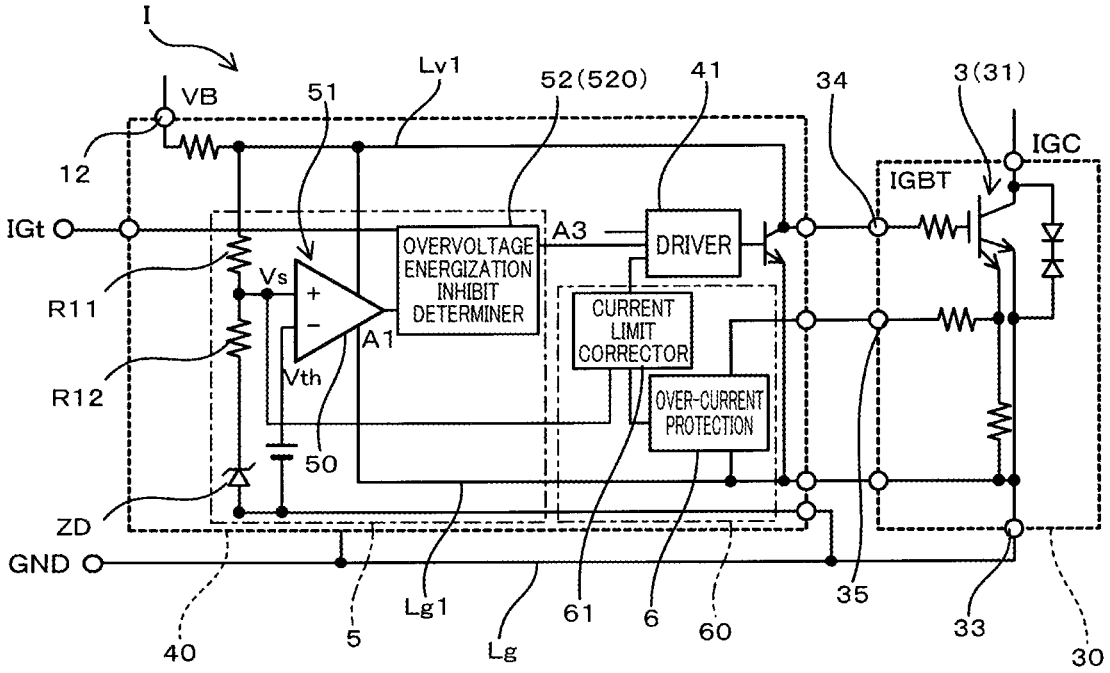
FIG. 8 is a circuit diagram which illustrates a structure of an igniter installed an ignition device according to the third embodiment.

The igniter I, as illustrated in FIG. 8, includes the switching circuit 30 and the control circuit 4. The control circuit 4 includes the drive circuit 41, the overvoltage protection circuit 5, and the current limiting circuit 60. The control circuit 4 also includes the filter circuit 42 and the lock release circuit 43 which are not illustrated in FIG. 8. The operations of such circuits are substantially identical with those in the first embodiment. In brief, the control circuit 4 controls the operation of the switching circuit 30 to protect it from overvoltage or overcurrent in response to input of the ignition signal IGt.

The current limit correcting circuit 61 is arranged between the overcurrent protection circuit 6 and the drive circuit 41 and works to determine the current limit I1 as a function of the power supply voltage VB and output it to the overcurrent protection circuit 6. The current limit correcting circuit 61 has an input of the voltage level Vs measured by the overvoltage detector 51 of the overvoltage protection circuit 5 and works to regulate the current limit I1 to be lower than normal when the voltage level Vs falls in a range which is defined near or above the overvoltage threshold level Vth to control the heat generated by the switching circuit 30.

Figure 9:
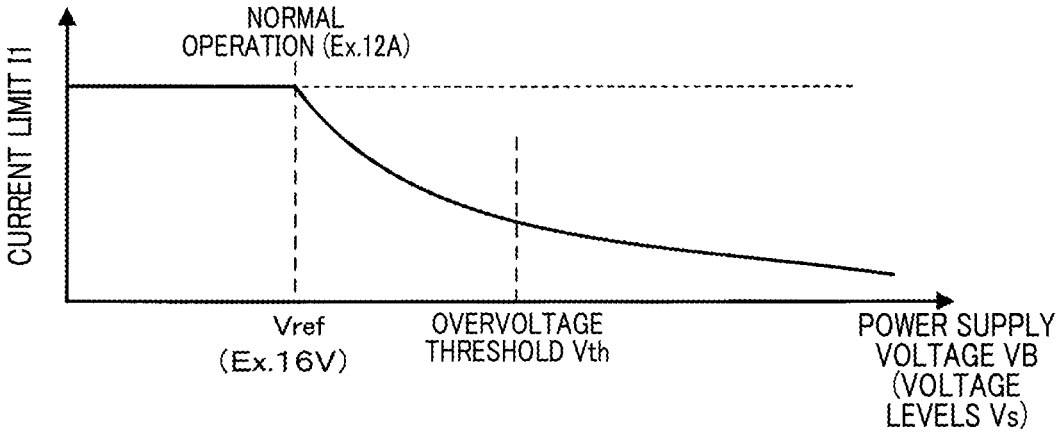
FIG. 9 is a view which demonstrates a relation among a power supply voltage, an overvoltage threshold value used in an overvoltage protection circuit, and a current limit used in an overvoltage protection circuit in the third embodiment.

Specifically, the current limit I1 is, as demonstrated in FIG. 9, set to a constant value (e.g., 12 A) at normal times when the voltage level Vs is lower than the reference voltage level Vref (e.g., 16V). In a range where the voltage level Vs is higher than the reference voltage level Vref, the current limit I1 is changed as a function of the voltage level Vs. Specifically, the current limit I1 is determined to be decreased with an increase in the voltage level Vs. The relation between the voltage level Vs and the current limit I1 may be changed as needed. For instance, the current limit I1 may be, as demonstrated in FIG. 9, set to decrease at a given rate from when the voltage level Vs exceeds the reference voltage level Vref close to the overvoltage threshold level Vth in a curved shape. The rate at which the current limit I1 is decreased is determined variably to decrease with a rise in the voltage level Vs. This causes the energizing current I to start decreasing greatly at a time when the voltage level Vs reaches the overvoltage threshold level Vth to protect the switching device 3.

Figure 10:
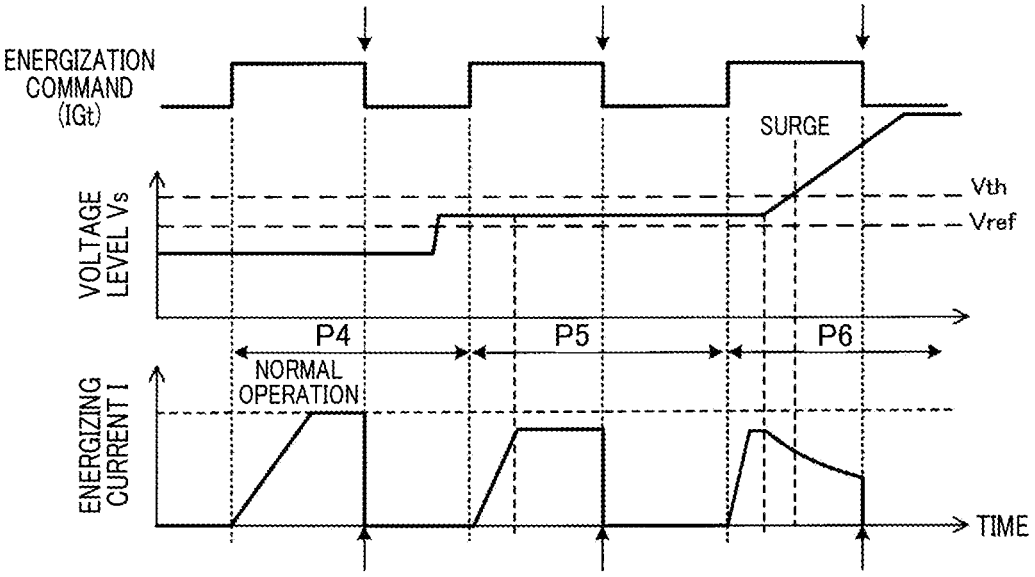
FIG. 10 is a time chart which demonstrates an overvoltage protection operation of an overvoltage protection circuit in the third embodiment.

When the measured voltage level Vs, as demonstrated in a comparative example in FIG. 10, rises in the period of time P5 or P6 following the period of time P4 that is a normal period of time when the voltage level Vs is at a normal level, the current limit I1 is changed as a function of the voltage level Vs. In the normal period of time P4 when the voltage level Vs is kept constant below the reference voltage level Vref, the energizing current I increases gradually. When the energizing current I increases gradually and then reaches the current limit I1, the overcurrent protection circuit 6 starts to be activated. This causes the energizing current I not to exceed the current limit I1. The output duration of the ignition signal IGt is usually short. The amount of heat generated by the switching device 3 is, therefore, reduced.

The measure voltage level Vs may be raised, as in the period of time P5, due to a variation in power supply voltage VB and then exceed the reference voltage level Vref. Such an event causes the energizing current I to be increased at a higher rate than in the period of time P6 to facilitate heating of the switching device 3. The current limit correcting circuit 61 is, therefore, activated to correct the current limit I1 to have a value I lower than that in the period of time P4. This causes the overcurrent protection circuit 6 to be activated at an advanced time, thereby reducing the electrical power supplied to the switching device 3 in a period of time in which the energizing current I reaches the current limit I1 to decrease the amount of heat generated by the switching device 3.

When high surge occurs, for example, in the period of time P6, so that the measured voltage level Vs increases from a constant value above the reference voltage level Vref, the current limit correcting circuit 61 gradually decreases the current limit I1 determined already. Specifically, the current limit correcting circuit 61 changes the current limit I1 as a function of the measured voltage level Vs in the way illustrated in FIG. 8 and outputs it to the overcurrent protection circuit 6. This reduces the electrical power supplied to the switching device 3 to decrease the amount of heat generated by the switching circuit 3 even when a period of time in which the energizing current I reaches the current limit I1 becomes long.

As apparent from the above discussion, the ignition device 1 in this embodiment is equipped with the current limit circuit 60 in addition to the overvoltage protection circuit 5 and designed to use the current limit correcting circuit 61 to change the current limit I1 in the overcurrent protection circuit 6, thereby enhancing the ability of the ignition device 1 to protect the igniter I from thermal damage. The above described relation between the power supply voltage VB and the current limit I1 may be modified. For example, the current limit I1 may be decreased in a stepwise fashion or start to be decreased after a time when the voltage level Vs reaches the overvoltage threshold level Vth.

Figure 11:
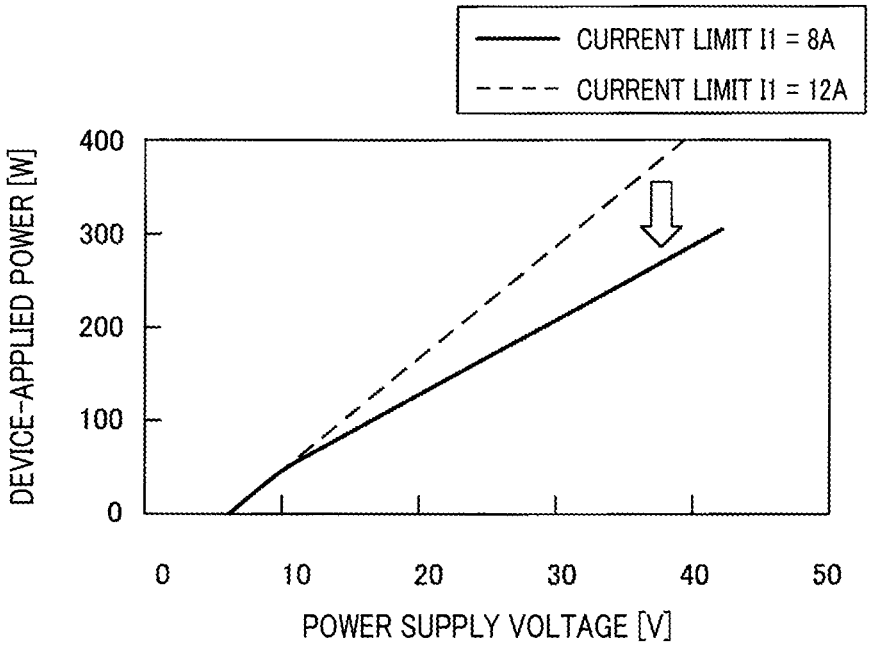
FIG. 11 is a view which illustrates a relation between a power supply voltage and a device-applied electrical power when a current limit is changed in the third embodiment.

FIG. 11 shows an example of a relation between the power supply voltage VB when surge current arising from overvoltage is inputted to the igniter I and an electrical power supplied to the switching device 3 (which will also be referred to as device-applied power). The device-applied power may be reduced by changing the current limit I1, for example, from 12 A to 8 A. The relation between the device-applied power and the current limit I1 and beneficial advantages offered by the current limit correcting circuit 61 of the current limit circuit 60 will be described below with reference to FIGS. 12A to 13B.

Figure 12A:
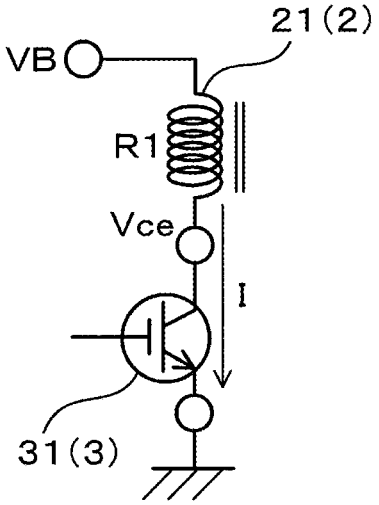
FIG. 12A is a circuit diagram which illustrates an ignition coil and a switching device in the third embodiment.
Figure 12B:
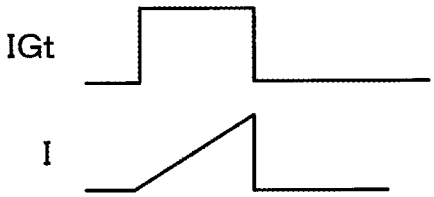
FIG. 12B is a view which demonstrates a relation between a coil-applied electrical power and a device-applied electrical power in a normal operation of an ignition device in the third embodiment.
Figure 13A:
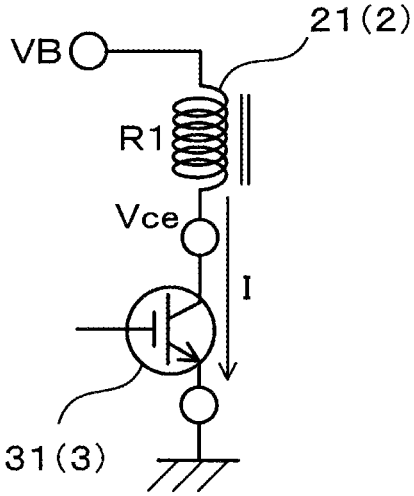
FIG. 13A is a circuit diagram which illustrates an ignition coil and a switching device in the third embodiment.
Figure 13B:
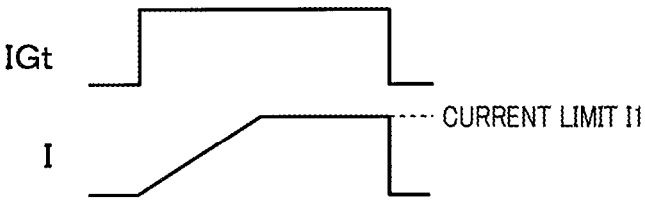
FIG. 13B is a view which demonstrates a relation between a coil-applied electrical power and a device-applied electrical power in an overvoltage protection operation of an ignition device in the third embodiment.

The electrical power, as referred to as coil-applied power in FIGS. 12B to 13B, applied to the primary winding 21 of the ignition coil 2 and the electrical power, as referred to as device-applied power in FIGS. 12B and 13B, applied to the switching device 3 are different between the normal operation mode and the overcurrent protection operation mode in the ignition device 1.

Normal Operation Mode $$\text{Coil-applied power}=(VB-V_{ce})^2/R1$$

$$\text{Device-applied power}=V_{ce}*I$$

where VB denotes power supply voltage (V), $V_{ce}$ denotes collector-to-emitter voltage (V) of the IGBT 31, R1 denotes resistance (Ω) of the primary winding 21, and I denotes primary current (A).

Overcurrent Protection Operation Mode $$\text{Coil-applied power}=R1*I1^2$$

$$\text{Device-applied power}=(VB-R1*I1)*I1$$

where VB represents power supply voltage (V), R1 represents resistance (Ω) of the primary winding 21, and I1 represents current limit (A).

In the normal operation mode, the voltage $V_{ce}$ at the IGBT 31 is, as can be seen in FIG. 12B, low (e.g., $V_{ce}$=1.5V), low so that the device-applied power will be low (e.g., when I=8 A, device-applied power is 8*1.5=12 W). This causes the electrical power applied to the ignition coil 2 to mainly contribute to generation of heat in the ignition coil 2 rather than the switching device 3. In contrast, when the amount of current flowing through the IGBT 31, as demonstrated in FIG. 13B, increases and then reaches the current limit I1, the ignition device 1 enters the overcurrent protection operation mode to control the energizing current I not to exceed the current limit I1. In this case, the current limit I1 is changed by controlling the voltage Vie at the IGBT 31, thereby causing the device-applied power to be higher than in the normal operation mode. The device-applied power is also varied by the resistance R1 of the primary winding 21.

The device-applied power may be controlled by keeping the resistance R1 of the primary winding 21 at a constant value (e.g., R1=0.5Ω) and variably controlling the current limit I1 by the current limit correcting circuit 61. For instance, the device-applied power may be, as shown in the following equations, reduced from 120 W to 96 W by decreasing the current limit I1 from 12 A to 8 A.

When VB=16V, I1=12 A, and R1=0.5Ω, the coil-applied power and the device-applied power are given by $$\text{Coil-applied power: } R1*I1^2=0.5*12^2=72\text{ W}$$

$$\text{Device-applied power:}(VB-R1*I1)*I1=(16-0.5*12)*12=120\text{ W}$$

When VB=16V, I1=8 A, and R1=0.5Ω, the coil-applied power and the device-applied power are given by $$\text{Coil-applied power: } R1*I1^2=0.5*8^2=32\text{ W}$$

$$\text{Device-applied power:}(VB-R1*I1)*I1=(16-0.5*8)*8=96\text{ W}$$

As apparent from the above equations, the device-applied power and the coil-applied power may be controlled by determining the resistance R1 of the ignition coil 2 to be an adequate value and variably controlling the current limit I1 as a function of a change in the power supply voltage VB.

The ignition device 1 in this embodiment, as described above, has the control circuit 4 which is equipped with the overvoltage protection circuit 5 and works to continue to output or stop outputting the energization inhibit signal A1 based on output states of the ignition signal IGt and the overvoltage signal A1, thereby protecting the igniter I from damage and also eliminating a risk that the engine may be damaged, for example, pre-ignition.

While the preferred embodiments have been disclosed in order to facilitate better understanding of the invention, it should be appreciated that the invention can be embodied in various ways without departing from the principle of the invention. For instance, the igniter I in each of the above embodiments may have a modification of the control circuit 4 or the switching circuit 30. The igniter I may also be used in internal combustion engines other than automotive engines. The ignition device 1 may be designed to have a structure modified to match specifications of internal combustion engines.

What is claimed is:

1. An ignition device comprising:

an ignition coil which includes a primary winding and a secondary winding and in which an electrical current flowing through the primary winding is changed to develop a high voltage at the secondary winding; and an igniter which works to energize or deenergize the ignition coil and includes a switching circuit and a control circuit, the switching circuit being equipped with a switching device connected to the primary winding, the control circuit working to control energization of the switching device based on an energization control signal, wherein the control circuit includes an overvoltage protection circuit which monitors a voltage level inputted to the primary winding and is configured to output an energization inhibit signal to inhibit supply of electrical current to the switching device in a range where the monitored voltage level is higher than an overvoltage threshold level, when the monitored voltage level exceeds the overvoltage threshold level in an output duration in which the energization control signal is outputted, the overvoltage protection circuit stops output of the energization inhibit signal until the output duration expires.

2. The ignition device as set forth in claim 1, wherein when the monitored voltage level exceeds the overvoltage threshold level in a non-output duration in which the energization control signal is not outputted, the overvoltage protection circuit is enabled to output the energization inhibit signal.

3. The ignition device as set forth in claim 1, wherein the overvoltage protection circuit includes an overvoltage detector and an energization enable determiner, the overvoltage detector outputting an overvoltage signal when the monitored voltage level is higher than the overvoltage threshold level, the energization enable determiner outputting an energization enable signal when the energization control signal starts to be outputted in a period of time in which the overvoltage signal is not outputted or when the overvoltage signal stops from being outputted in a period of time in which the energization control signal is being outputted, and wherein the overvoltage protection circuit determines whether the energization inhibit signal should be outputted based on a determination of whether the energization enable signal is being outputted.

4. The ignition device as set forth in claim 3, wherein the overvoltage protection circuit stops the energization inhibit signal from being outputted in a period of time in which the energization enable signal is being outputted.

5. The ignition device as set forth in claim 3, wherein the overvoltage protection circuit includes an AND circuit that is configured to output the energization inhibit signal based on the overvoltage signal and an inversion of the energization enable signal.

6. The ignition device as set forth in claim 1, wherein the control circuit includes an overcurrent protection circuit which monitors an electrical current flowing through the switching device and controls the electrical current to be below a current limit, and wherein the overcurrent protection circuit is equipped with a current limit correcting circuit which variably sets the current limit in a range in which the monitored voltage level is higher than a reference voltage level which is lower than the overvoltage threshold level.

7. The ignition device as set forth in claim 6, wherein the current limit correcting circuit decreases the current limit as an increase in the monitored voltage level.

8. The ignition device as set forth in claim 1, wherein:

the monitored voltage level is a fraction of a power supply voltage level; and the monitored voltage level becomes higher than the overvoltage threshold level when the power supply voltage is raised by a voltage surge.

* * * * *